US005174176A

United States Patent [19]

Krivec

[11] Patent Number: 5,174,176

[45] Date of Patent: Dec. 29, 1992

[54] REVERSIBLE RACHET WRENCH WITH INTEGRATED DUAL PAWL AND SPRING AND CAM UNIT

[75] Inventor: Bert Krivec, Wauskesha, Wis.

[73] Assignee: Snap-on Tools Corporation, Kenohsa, Wis.

[21] Appl. No.: 803,588

[22] Filed: Dec. 9, 1991

[51] Int. Cl.[5] ..... B25B 13/46

[52] U.S. Cl. ..... 81/63.1; 81/62

[58] Field of Search ..... 81/60–63.2

[56] References Cited

U.S. PATENT DOCUMENTS

| | | | |
|---|---|---|---|
| 1,388,923 | 8/1921 | Bullard | 81/63.1 X |
| 2,193,984 | 3/1940 | Rhinevault . | |
| 2,701,977 | 2/1955 | Stone . | |
| 2,803,980 | 8/1957 | Vogel . | |
| 2,978,081 | 4/1961 | Lundin | 87/63.1 X |
| 3,145,594 | 8/1964 | Peters | 81/63 |
| 3,233,481 | 2/1966 | Bacon . | |
| 3,250,157 | 5/1966 | Badger . | |
| 3,356,117 | 12/1967 | Wagner | 81/63 |

*Primary Examiner*—James G. Smith
*Attorney, Agent, or Firm*—Emrich & Dithmar

[57] ABSTRACT

A reversible ratchet wrench has a housing containing a ratchet wheel and a reversing pawl unit which includes two pawls respectively connected by leaf springs to a pivotally mounted reversing cam, all in a unitary one-piece construction. The reversing pawl unit is pivotally movable by a reversing lever between first and second conditions, wherein the two pawls respectively engage the ratchet wheel for accommodating rotation thereof in opposite directions. The reversing lever has a cam follower which cammingly engages a cam surface on the housing to resiliently hold the reversing lever in the selected one of its two positions.

17 Claims, 1 Drawing Sheet

REVERSIBLE RACHET WRENCH WITH INTEGRATED DUAL PAWL AND SPRING AND CAM UNIT

BACKGROUND OF THE INVENTION

1. Field of the Invention

The present invention relates to ratchet wrenches and, in particular, to reversible ratchet wrenches and the reversing mechanism thereof.

2. Description of the Prior Art

In a reversible ratchet wrench, a reversing pawl mechanism is engageable with a ratchet wheel in either of two conditions for respectively accommodating rotation of the ratchet wheel in opposite directions relative to the wrench housing during the back stroke of the wrench. Typically, the pawl mechanism is a multi-part assembly, including two pawls or a single pawl with two lobes, two pawl bias members in the case of a two-pawl mechanism, or a single bias means consisting typically of two members in the case of a lobed pawl, and a reversing lever, usually pivotally movable, for shifting the pawl or pawls between their two conditions for effecting forward or reverse ratcheting. This multi-part construction is difficult and expensive to manufacture and assemble, and is subject to errors in the assembly process. While the use of a dual-lobed pawl instead of two pawls reduces the number of parts somewhat, the assembly still requires at least a pawl element, a bias element and a pivoting cam or lever element along with associated attachment elements.

SUMMARY OF THE INVENTION

It is a general object of the invention to provide an improved ratchet wrench which avoids the disadvantages of prior wrenches while affording additional structural and operating advantages.

An important feature of the invention is the provision of a reversible ratchet wrench which is of relatively simple and economical construction and characterized by ease of assembly.

In connection with the foregoing feature, another feature of the invention is the provision of a reversible ratchet wrench of the type set forth, which includes a reversing pawl mechanism comprising a minimal number of parts.

In connection with the foregoing features, a still further feature of the invention is the provision of a ratchet wrench of the type set forth, wherein the pawl bias element is unitary with the pawl or pawls and/or with a pivotal reversing cam.

These and other features of the invention are attained by providing in a reversible ratchet wrench having a housing containing a ratchet wheel and two pawls respectively engageable with the ratchet wheel for respectively accommodating rotation thereof in opposite directions relative to the housing during the back stroke of the wrench, the improvement comprising: bias means integral with both of the pawls and resiliently urging the pawls toward engagement with the ratchet wheel, and reversing means integral with the bias means and selectively moveable between first and second positions, the reversing means in its first position allowing one of the pawls to engage the ratchet wheel and holding the other pawl out of engagement with the ratchet wheel against the urging of the bias means, the reversing means in its second position allowing the other pawl to engage the ratchet wheel and holding the one pawl out of engagement with the ratchet wheel against the urging of the bias means.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
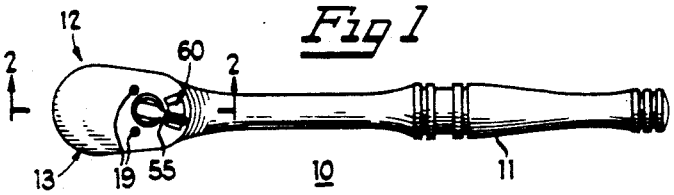
FIG. 1 is a top plan view of a reversible ratchet wrench constructed in accordance with and embodying the features of the present invention.
Figure 2:
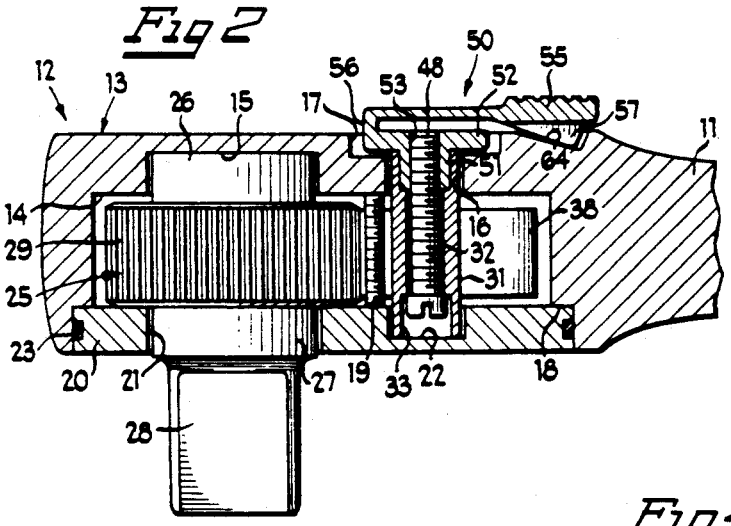
FIG. 2 is an enlarged, fragmentary view in vertical section taken along the line 2—2 in FIG. 1.
Figure 3:
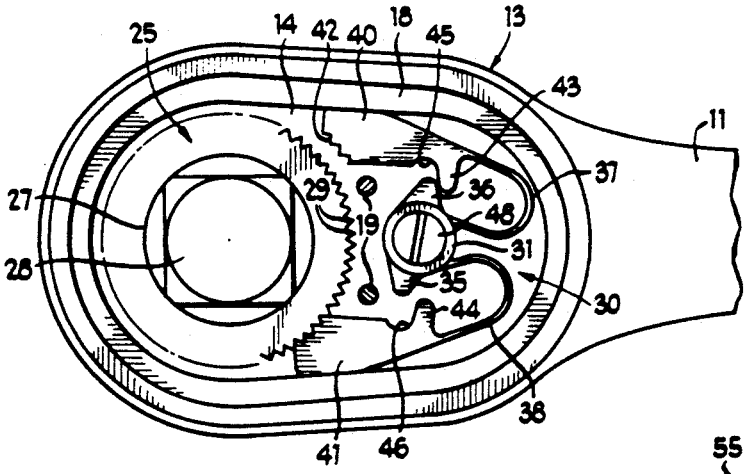
FIG. 3 is a fragmentary bottom plan view of the wrench illustrated in FIG. 2, with the cover plate removed to more clearly illustrate the internal construction.

Referring to FIGS. 1-3, there is illustrated a reversible ratchet wrench 10, constructed in accordance with and embodying the features of the present invention. The wrench 10 includes a handle 11 provided at one end thereof with a head 12. The head 12 includes a housing 13 which is unitary with the handle 11 and is provided with a generally oval-shaped cavity 14 in one face thereof, the cavity 14 having a cylindrical recess 15 at the bottom thereof. Also formed through the bottom wall of the housing 13 is a cylindrical bore 16 having a counterbore 17. A shoulder 18 is formed around the periphery of the cavity 14 adjacent to the outer end thereof.

The housing 13 is connected by screws 19 to a cover plate 20 which, in use, rests upon the shoulder 18 for closing the outer end of the cavity 14. The cover plate 20 has a depth substantially equal to the depth of the shoulder 18 so that the outer face of the cover plate 20 is substantially flush with the adjacent face of the housing 13. The cover plate 20 has a cylindrical bore 21 therethrough coaxial with the recess 15 in the cavity 14. Also formed in the inner surface of the cover plate 20 is a cylindrical recess 22 coaxial with the bore 16 in the housing 13. Preferably, a groove is formed in the outer wall of the cover plate 20 around the periphery thereof and receives therein a suitable sealing ring 23.

A ratchet wheel 25 is disposed in the cavity 14 and has a cylindrical inner hub 26 rotatably seated in the recess 15 and an outer cylindrical hub 27 rotatably received through the bore 21 in the cover plate 20. The outer hub 27 is unitary with an outwardly projecting square drive lug 28 for attachment to associated socket tools in standard fashion. The ratchet wheel 25 is provided with a plurality of peripheral ratchet teeth 29, all in a known manner.

Figure 4:
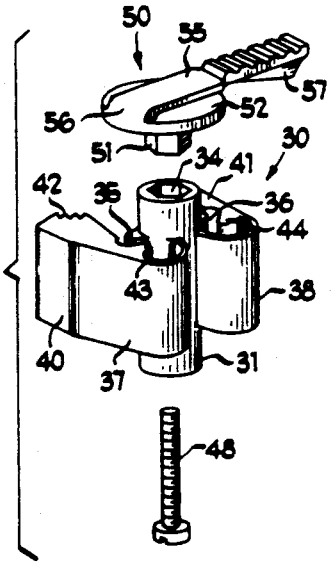
FIG. 4 is an exploded perspective view of the reversing pawl assembly of the wrench of FIGS. 2 and 3.

Referring now also to FIG. 4, the Wrench head 12 also contains a reversing pawl unit 30, which has a cylindrical hub 31 having an axial bore 32 (FIG. 2) therethrough provided with a cylindrical counterbore 33 at one end thereof and a hexagonal counterbore 34 at the other end thereof. Unitary with the hub 31 and projecting generally radially outwardly therefrom at substantially diametrically opposed locations thereon are a pair of axially elongated cam lobes 35 and 36. Also unitary with the hub 31 and projecting outwardly therefrom are a pair of generally U-shaped leaf springs 37 and 38, each having an axial extent substantially the same as that of the cam lobes 35 and 36. Respectively unitary with the leaf springs 37 and 38 at the distal ends thereof are pawls 40 and 41, each provided at its distal end with a plurality of teeth 42. Respectively unitary with the pawls 40 and 41 adjacent to their junctions with the leaf springs 37 and 38 are a pair of fingers 43 and 44 which, respectively, project inwardly toward the hub 31. Arcuate recesses 45 and 46 are respectively formed in the inner surfaces of the pawls 40 and 41, respectively adjacent to the fingers 43 and 44. Thus, the reversing pawl unit 30 includes two pawls 40 and 41, two bias springs 37 and 38 and a reversing cam mechanism 31, 35 and 36, all formed in a single piece, thereby to greatly simplify assembly of the wrench 10. Preferably, the reversing pawl unit 30 is formed of a suitable metal such as a suitable spring or tool steel or a suitable stainless steel, any of which may be locally hardened in the region of the pawl teeth, if desired.

In assembly, the reversing pawl unit 30 is disposed in the cavity 14 with the end of the hub 31 having the hexagonal counterbore 34 therein being rotatably disposed in the bore 16. The unit 30 is oriented so that the pawls 40 and 41 project forwardly toward the ratchet wheel 25, and the leaf springs 37 and 38 project rearwardly toward the handle 11. A fastener, such as a machine screw 48, is received through the bore 32 in the hub 31 with the screw head being seated in the cylindrical counterbore 33.

The wrench 10 also includes a reversing member 50, which has a hexagonal hub 51 adapted to fit matingly in the hexagonal counterbore 34 of the reversing pawl unit 30. Unitary with the hub 51 and extending radially outwardly therefrom at the outer end thereof is a circular flange 52 which is receivable in the counterbore 17. The reversing member 50 has an internally threaded axial bore 53 extending therethrough which, in use, is disposed coaxially with the bore 32 through the hub 31 of the reversing pawl unit 30. Unitary with the circular flange 52 is an elongated lever arm 55 which is connected to the circular flange 52 at the perimeter thereof by an unitary upstanding attachment portion 56. As can best be seen in FIG. 2, the lever arm 55 is spaced a slight distance above the outer surface of the circular flange 52 and extends diametrically thereacross and radially outwardly therebeyond. The reversing member 50 is formed of a suitable metal, so that the cantilever attachment of the lever arm 55 results in its having a limited resilient flexibility in directions generally axially of the reversing member 50. Depending from the lever arm 55 at its distal end is a generally triangular cam follower finger 57.

It will be appreciated that, in assembly, the screw 48 is threadedly engaged with the reversing member hub 51 to fixedly secure the reversing member 50 to the reversing pawl unit 30. To complete assembly, the cover plate 20 is mounted in place on the shoulder 18, with the adjacent end of the cylindrical hub 31 of the reversing pawl unit 30 being rotatably seated in the recess 22. The cover plate 20 is then secured in place with the screws 19.

Figure 5:
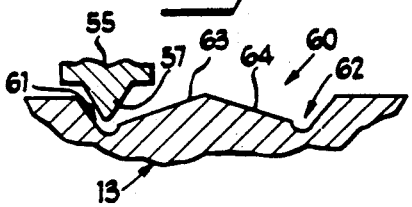
FIG. 5 is an enlarged, fragmentary, sectional view illustrating the operation of the reversing lever arm.

Preferably, the thickness of the circular flange 52 is substantially the same as the depth of the counterbore 17, so that when the parts are assembled, the outer surface of the circular flange 52 is substantially flush with the adjacent face of the housing 13. Thus, it will be appreciated that the lever arm 55 will be spaced a slight distance outwardly from the adjacent face of the housing 13. Referring also to FIG. 5, the face of the housing 13 has a cam indent 60 formed therein just rearwardly of the counterbore 17. The indent 60 includes cam recesses 61 and 62 dimensioned for accommodating the cam follower finger 57 therein. The cam recesses 61 and 62 are arcuately spaced apart by a raised projection which is generally triangular in transverse cross section and defines inclined cam surfaces 63 and 64. Thus, it will be appreciated that when the cam follower finger 57 is disposed in either one of the cam recesses 61 or 62, the associated cam surfaces 63 or 64 will inhibit pivotal movement of the reversing member 50 about its axis. The limited resilient flexibility of the lever arm 55 will, however, permit the cam follower finger 57 to be manually cammed past the cam surfaces 63 or 64 and permit pivotal movement of the reversing member 50 by a user between the cam recesses 61 and 62 which correspond, respectively, to the forward and reverse conditions of the reversing pawl unit 30.

Referring now in particular to FIGS. 3 and 5, in operation, the reversing pawl unit 30 is shiftable between forward and reverse conditions for respectively engaging the pawls 40 and 41 with the ratchet wheel 25, thereby respectively defining the forward and reverse operational modes of the wrench 10 in a known manner. When the wrench 10 is rotated through its back stroke, the ratchet wheel 25 ratchets past the engaged one of the pawls 40 and 41, imparting to that pawl an oscillatory ratcheting movement. This movement is resisted by the associated one of the leaf springs 37 and 38, which serve to bias the engaged pawl into engagement with the ratchet wheel 25. Referring to FIG. 5, it can be seen that, for example, when the pawl 41 is engaged with the ratchet wheel 25, the lever arm 55 will be disposed with its cam follower finger 57 seated in the cam recess 62, whereas when the pawl 40 is engaged with the ratchet wheel 25, the cam follower finger 57 will be seated in the cam recess 61.

When the ratchet wheel 25 is rotated during the back stroke of the wrench 10, the oscillatory ratcheting movement of the engaged one of the pawls 40 and 41 will tend to rotate the hub 31 of the reversing pawl unit 30 about its axis. However, the cam force of the cam surface 63 or 64 resisting rotation of the reversing member 50 is substantially greater than the pivoting force exerted on the hub 31 by the leaf spring 37 or 38 connected to the engaged pawl. Thus, the lever arm 55 will not move in response to the ratcheting movement of the engaged pawl.

From the foregoing, it can be seen that there has been provided an improved reversible ratchet wrench which is of simple and economical construction and is characterized by a minimal number of parts. More specifically, the reversing mechanism comprises only three parts, viz., the reversing pawl unit 30, the reversing member 50 and the screw 48.

I claim:

1. In a reversible ratchet wrench having a housing containing a ratchet wheel and two pawls respectively engageable with the ratchet wheel for respectively accommodating rotation thereof in opposite directions relative to the housing during the back stroke of the wrench, the improvement comprising: bias means resiliently urging the pawls toward engagement with the ratchet wheel, and reversing means unitary with said bias means in a one-piece construction and selectively moveable between first and second positions, said reversing means in its first position allowing one of the pawls to engage the ratchet wheel and holding the other pawl out of engagement with the ratchet wheel against the urging of said bias means, said reversing means in its second position allowing said other pawl to engage the ratchet wheel and holding said one pawl out of engagement with the ratchet wheel against the urging of said bias means.

2. The ratchet wrench of claim 1, wherein said reversing means includes means accommodating pivotal movement thereof between the first and second positions thereof.

3. The ratchet wrench of claim 2, wherein said bias means includes two bias springs respectively associated with the pawls.

4. The ratchet wrench of claim 3, wherein each of said bias springs is a leaf spring.

5. The ratchet wrench of claim 1, and further comprising second bias means resiliently resisting movement of said reversing means from the selected one of its first and second positions.

6. The ratchet wrench of claim 5, wherein said second bias means includes cam means formed on said housing, and cam follower means on said reversing means disposed in camming engagement with said cam means.

7. In a reversible ratchet wrench having a housing containing a ratchet wheel and two pawls respectively engageable with the ratchet wheel for respectively accommodating rotation thereof in opposite directions relative to the housing during the back stroke of the wrench, the improvement comprising: bias means unitary with both of the pawls in a one-piece construction and resiliently urging the pawls toward engagement with the ratchet wheel, and reversing means selectively moveable between first and second positions, said reversing means in its first position allowing one of the pawls to engage the ratchet wheel and holding the other pawl out of engagement with the ratchet wheel against the urging of said bias means, said reversing means in its second position allowing said other pawl to engage the ratchet wheel and holding said one pawl out of engagement with the ratchet wheel against the urging of said bias means.

8. The ratchet wrench of claim 7, wherein said bias means includes two bias springs respectively associated with the pawls.

9. The ratchet wrench of claim 8, and further comprising means coupling said bias springs to said reversing means.

10. The ratchet wrench of claim 7, and further comprising second bias means resiliently resisting movement of said reversing means from the selected one of its first and second positions.

11. The ratchet wrench of claim 10, wherein said reversing means includes means accommodating pivotal movement thereof between the first and second positions thereof.

12. The ratchet wrench of claim 11, wherein said second bias means includes cam means formed on said housing.

13. In a reversible ratchet wrench having a housing containing a ratchet wheel and two pawls respectively engageable with the ratchet wheel for respectively accommodating rotation thereof in opposite directions relative to the housing during the back stroke of the wrench, the improvement comprising: bias means unitary with both of the pawls in a one-piece construction and resiliently urging the pawls toward engagement with the ratchet wheel, and reversing means unitary with said bias means in a one-piece construction and selectively moveable between first and second positions, said reversing means in its first position allowing one of the pawls to engage the ratchet wheel and holding the other pawl out of engagement with the ratchet wheel against the urging of said bias means, said reversing means in its second position allowing said other pawl to engage the ratchet wheel and holding said one pawl out of engagement with the ratchet wheel against the urging of said bias means.

14. The ratchet wrench of claim 13, wherein said unitary one-piece construction is formed of steel.

15. The ratchet wrench of claim 13, wherein said reversing means includes means accommodating pivotal movement thereof between the first and second positions thereof.

16. The ratchet wrench of claim 15, wherein said bias means includes two bias springs respectively connecting the pawls to said reversing means.

17. The ratchet wrench of claim 13, and further comprising second bias means for resiliently resisting movement of said reversing means from the selected one of its first and second positions, said second bias means including cam means on said housing and cam follower means on said reversing means disposed in camming engagement with said cam means.

* * * * *